United States Patent [19]

Klostermann et al.

[11] Patent Number: 4,599,924

[45] Date of Patent: Jul. 15, 1986

[54] PROCESS AND DEVICE TO APPLY A BEARING EYE OR A TRANSVERSE PERFORATION IN THE CLEVIS OF THE ACTUATING ROD OF A BRAKE POWER BOOSTER

[75] Inventors: Gerd Klostermann, Friedrichsdorf; Nabil Henein, Darmstadt, both of Fed. Rep. of Germany

[73] Assignee: ITT Industries, Inc., New York, N.Y.

[21] Appl. No.: 622,707

[22] Filed: Jun. 20, 1984

[30] Foreign Application Priority Data

Jun. 22, 1983 [DE] Fed. Rep. of Germany ..... 3322423

[51] Int. Cl.[4] ..... B23D 21/14

[52] U.S. Cl. ..... 83/50; 29/463; 83/188; 83/195; 83/925 R; 408/105

[58] Field of Search ..... 83/50, 925 R, 188, 192, 83/193, 194, 178, 179, 195; 188/32.11; 408/72 R, 707, 97, 105; 29/150, 463; 269/46, 87.3, 254 CS

[56] References Cited

U.S. PATENT DOCUMENTS 1,734,008 10/1929 Frehse ..... 29/150
2,829,983 4/1958 De Gain ..... 83/188
3,063,237 11/1962 Onulak ..... 83/194

FOREIGN PATENT DOCUMENTS 1442744 7/1976 United Kingdom .
2075633 11/1981 United Kingdom .

*Primary Examiner*—Frank T. Yost
*Assistant Examiner*—Hien H. Phan
*Attorney, Agent, or Firm*—James B. Raden; Donald J. Breh

[57] ABSTRACT

A process and device for producing a bearing eye or a transverse perforation in the clevis of the actuating rod of a brake power booster. The assembled brake power booster is inserted in a locking frame of the device, the clevis being retained at a cutting tool provided in a locking frame at a desired design distance of the clevis from the fixation flange of the booster casing. Upon insertion of the booster in the locking frame, the legs of the clevis are punched by a cutting punch so that in a single process step, a transverse punch hole or perforation to receive the pivot pin of the brake pedal is made maintaining a close tolerance to the desired design distance, i.e. independently of the specific position of mounting of the actuating rod and independent of the distance between the end of the clevis and the fixation flange of the booster casing.

5 Claims, 1 Drawing Figure

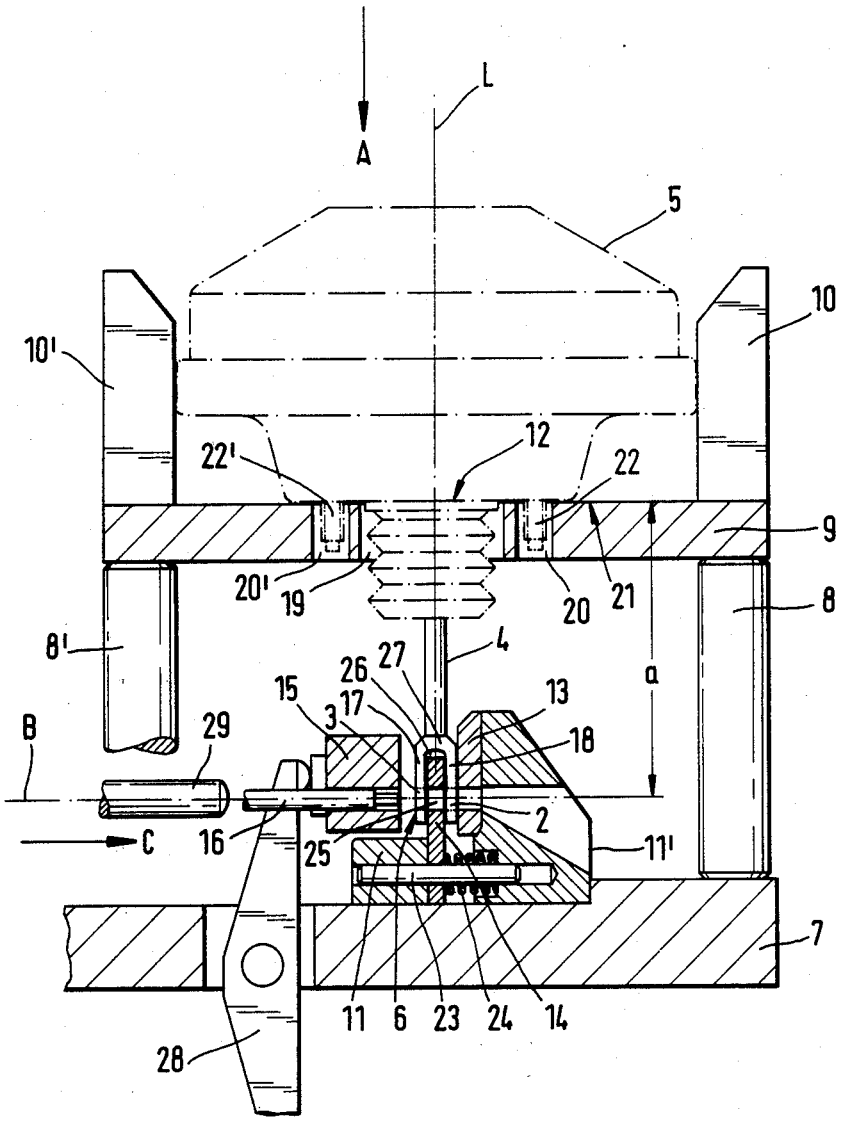
L
A
5
10
10'
12
22'
22
9
20'
19
20
21
8
8'
4
a
26
27
15
3
17
13
18
B
29
2
C
16
25
11'
7
11
6
23
24
14
28

PROCESS AND DEVICE TO APPLY A BEARING EYE OR A TRANSVERSE PERFORATION IN THE CLEVIS OF THE ACTUATING ROD OF A BRAKE POWER BOOSTER

BACKGROUND OF THE INVENTION

The present invention relates to a process and to a device for applying a bearing eye or a transverse perforation in a clevis adapted to be rigidly secured to the free end of the actuating rod of a brake power booster and serving to receive the pivot pin of a brake operating lever.

According to conventional practice in automotive vehicles, the actuating rod of the brake power booster is fitted with a clevis furnished with a transverse perforation. The clevis may be rigidly connected to the actuating rod by a screwed union (GB patent specification No. 1,586,639) or may be welded to the actuating rod (German printed and published patent application No. 3,013,456). In the first mentioned version, it is necessary on securing the brake power booster to the splashboard of the vehicle or to the vehicle body to exactly adjust the distance of the clevis from the fixation flange of the booster. Otherwise the brake pedal or pedal rod linkage subsequently fastened to the vehicle body would not exactly fit, with the result of an undesirable lost motion travel occurring at the brake pedal. In the last mentioned configuration of the actuating rod, it is necessary to provide the pedal rod linkage with an adjusting facility, or else any tolerances regarding the distance of the clevis or rather of its transverse perforation from the fixation flange of the booster would no longer allow to be balanced. Both methods raise disadvantages for the automotive vehicle manufacturer in that considerable time must be spent for mounting conventionally manufactured brake power boosters in the automotive vehicle, with the ultimate result, among others, of added cost increases.

SUMMARY OF THE INVENTION

All prior practical attempts to resolve this problem have failed. The problem is one of configuring the brake power booster so that any tolerances within the booster are balanced during assembly of the component parts of the brake power booster in a way that the distance between the transverse perforation of the clevis and the fixation flange can be maintained. To resolve the problem the inventor must create a process and a device which enables allowing the rated design distance between the fixation flange and the transverse perforation of the clevis to be maintained in a production manufacturing process, without the necessity of exactly tuning or selectively incorporating certain components in the inner space of the booster. In particular, the present manufacturing process is intended to have as its primary objective, the elimination of the need for specially trained qualified labor.

According to the present invention, the primary objective is attained in that the assembled brake power booster including casing and actuating rod with clevis is inserted in a locking frame in the first process step. The clevis is retained by a cutting tool at the rated design distance from the fixation flange of the booster casing and on its insertion is punched by a cutting punch being moved transversely to the longitudinal direction of the actuating rod in a second process step, the cutting punch cutting a patch or segment out of the first leg of the clevis.

In a booster whose clevis has a transverse perforation in both legs, the assembled brake power booster including casing and actuating rod with clevis is preferably inserted in a locking frame in the first process step. The clevis is retained by a cutting tool at the rated design distance from the fixation flange of the casing of the brake power booster and on its insertion is punched by a cutting punch being moved transversely to the longitudinal direction of the actuating rod in a second process step, the cutting punch first cutting a patch or segment out of the first leg of the clevis and then driving the cut patch or segment through the second leg of the clevis.

In a device designed for application of the process, there is provided (1) a stop plate to retain the casing of the brake power booster in the direction toward the clevis, (2) a head plate to which the punching tool is mounted, (3) an actuating rod for the clevis which extends through a recess in the stop plate straddling a cutting plate which is supported by the pedestal of the cutting tool, with the legs of the clevis being retained between the punch guide plate and the die bed, and (4) the claws of the locking frame securing the casing of the brake power booster against its displacement in a direction at right angles to the longitudinal axis of the actuating rod. The distance from the lateral face of the stop plate which abuts with the fixation flange of the casing down to the axis of movement of the cutting punch corresponds to a desired rated design measure.

Preferably, the cutting plate engaging between the legs of the clevis and retained on the head plate by the pedestal of the cutting tool is supported movably transversely to the longitudinal axis of the actuating rod. The advantage of this movement arises when the punch guide plate serving to press the clevis against the die bed supported by the head plate of the locking frame and by the pedestal is held and guided in a transverse direction relative to the longitudinal axis of the actuating rod.

The invention allows a number of varied embodiments. One device suited for the application of the process is illustrated in detail in the accompanying drawing.

DETAILED DESCRIPTION

The device shown diagrammatically in the drawing essentially comprises a locking frame which consists of a head plate 7, a plurality of struts 8 and 8' arranged parallel to one another on the head plate 7, and a stop plate 9 held at a distance from the head plate 7 by the struts 8 and 8'. Claws 10 and 10' secured on the stop plate 9 parallel to one another and serve to secure the casing 5 against a lateral displacement.

On the head plate 7, there is fastened a cutting tool substantially composed of a die bed 13, a cutting plate 14 and a punch guide plate 15.

The assembled brake power booster (the drawing shows a vacuum brake power booster, but a hydraulic booster may just as well be provided in its place) is rested on the stop plate 9 in the direction indicated by the arrow A in such a manner that the actuating rod 4 with clevis 6 extends downwardly through the stop plate recess 19. The claws 10 and 10' extending in an upward direction from the stop plate 9 embrace the casing 5 of the booster to laterally retain the casing 5 thereby preventing the casing 5 from being displaced parallel to the plane of the stop plate 9. At least three claws of which two 10 and 10' shown are required for the purpose. The stop plate 9 has further additional bores 20, 20' . . . which are engaged in downward direction by the fastening screws, 22, 22' . . . of the fixation flange 12 of the casing 5. On the head plate 7 of the locking frame, that is on its pedestal 11 and 11', a guide pin 23 is supported and guided on which the cutting plate 14 is arranged displaceably in the direction of the arrow C against the force of a compression spring 24. The cutting plate 14 is provided with an opening 25 for the penetration of the cutting punch 16 and is straddled by the two legs 17 and 18 of the clevis 6 in the inserted condition of the brake power booster. The cutting plate 14 has a thickness sufficient to fill the space between the two facing lateral faces of two legs 17 and 18 of the clevis. A clearance 26 is however left between the upper narrow face of the cutting plate 14 and the yoke section 27 of the clevis 6 to balance tolerances, if any, relative to the rated design distance "a".

Upon insertion of the booster in the locking frame, the punch guide plate 15 is displaced in the direction indicated by the arrow C by pivoting a lever 28 supported in the head plate 7, until the punch guide plate 15 presses the clevis 6 firmly against the die bed 13 of the punching tool. Subsequently, the piston 29 is operated to drive the cutting punch 16 in the direction of the arrow C against the leg 17 of the clevis 6, the cutting punch 16 then cutting a hole in the leg 17. The punch drives the cut patch through the opening 25 in the cutting plate 14 and finally through the leg 18 of the clevis 6 so that a through-opening is formed transversely through the clevis 6.

It is an important advantage of the described process that the opening extending transversely through both legs 17 and 18 of the clevis 6 has a rated design distance "a" from the fixation flange 12 of the casing 5 of the booster. The rated distance "a" is provided in any and all boosters which are tooled in the manner described, and, for that matter, irrespective of any potential tolerances with regard to the length of the actuating rod 4 or to the latter's specific mounting position. All boosters tooled in this manner may subsequently be mounted in the vehicle without the risk of an undesirable lost motion travel coming about at the brake operating lever or at the brake pedal (not shown in the drawing) connected to the clevis 6.

What is claimed is:

1. A process to produce a bearing eye or a transverse perforation in a pair of legs of a clevis adapted to be rigidly secured to a free end of an actuating rod extending from a casing of a brake power booster having a fixation flange adapted to be mounted to a surface of a vehicle, said transverse perforation in the legs of the clevis adapted to receive a pivot pin of a brake operating lever, the invention in which the steps comprise first inserting an assembled brake power booster in a locking frame with said clevis retained by a cutting tool at a rated design distance from said fixation flange of the booster casing and thereafter moving a cutting punch transversely to the longitudinal direction of said actuating rod to enable said cutting punch to cut a patch or segment out of at least one of said pair of legs of said clevis.

2. The process as claimed in claim 1 further comprising the step of driving the cut patch or segment from said one leg of said pair of legs and said cutting punch through the second of said pair of legs of said clevis.

3. A device for providing a transverse perforation in a pair of legs of a clevis which is adapted to be rigidly secured to the free end of an actuating rod of a power brake booster of the type having a casing and a fixation flange defining a fixation surface adapted to be mounted to a surface of a vehicle in which the transverse perforation in the pair of legs of the clevis is adapted to receive a pivot pin of a brake operating lever, the device including a stop plate having a lateral surface, means for retaining the casing of the brake power booster to said stop plate with said fixation surface against said lateral surface, a head plate including a cutting tool for retaining said clevis, the actuating rod and said clevis extend through a recess in said stop plate, said pair of legs of said clevis straddle a cutting plate which is supported by a first portion of a pedestal of said cutting tool, said clevis being retained between a punch guide plate adapted to removably engage one of said pair of legs and a die bed against the second of said pair of legs, said means for retaining the casing including a plurality of claws on the locking frame securing the casing of the brake power booster against its displacement in a direction at right angles to the longitudinal axis of said actuating rod, whereby the distance from the lateral face of said stop plate against which said fixation flange of said casing abutsto the axis of movement of said cutting punch corresponds to a desired predetermined distance.

4. A device as claimed in claim 3, in which the pedestal of said cutting tool which supports said cutting plate is mounted on said head plate for movement transversely to the longitudinal axis of said actuating rod.

5. A device as claimed in claim 3, in which said die bed is supported by a second portion of said pedestal of said cutting tool, said first and said second pedestal portions supported by said head plate of the locking frame.

* * * * *